United States Patent [19]

Bassi et al.

[11] Patent Number: 4,690,178

[45] Date of Patent: Sep. 1, 1987

[54] MOBILE HOOK FOR THE SHED FORMING DEVICE OF A WEAVING LOOM

[75] Inventors: Dario Bassi, Corbas; Joseph Palau, Duingt, both of France

[73] Assignee: Establissements Staubli Verdol, Chassieu, France

[21] Appl. No.: 896,272

[22] Filed: Aug. 14, 1986

[30] Foreign Application Priority Data

Aug. 23, 1985 [FR] France ..... 85 12817

[51] Int. Cl.[4] ..... D03C 13/00; D03C 3/00; D03C 3/06

[52] U.S. Cl. ..... 139/455; 139/59; 139/65

[58] Field of Search ..... 139/55.1, 59, 65, 455, 139/317, 319, 320

[56] References Cited

U.S. PATENT DOCUMENTS

| | | | |
|---|---|---|---|
| 1,678,325 | 7/1928 | Butin et al. | 139/319 |
| 2,136,076 | 11/1938 | Fisher et al. | 139/319 |
| 3,103,953 | 9/1963 | Lauritsen | 139/455 |
| 3,240,235 | 3/1966 | Burgess | 139/317 |
| 3,835,894 | 9/1974 | Speich | 139/59 |
| 3,938,560 | 2/1976 | Lauritsen | 139/59 |
| 4,041,987 | 8/1977 | Bucher | 139/59 |
| 4,515,186 | 5/1985 | Durville et al. | 139/65 |
| 4,532,963 | 8/1985 | Bastion et al. | 139/59 |
| 4,593,723 | 6/1986 | Griffith | 139/455 |

*Primary Examiner*—Harvey C. Hornsby
*Assistant Examiner*—Joseph S. Machuga
*Attorney, Agent, or Firm*—Dowell & Dowell

[57] ABSTRACT

This invention is directed to improved mobile hooks for the shed forming device of weaving looms wherein the mobile hooks are disposed at each of the ends of a funicular element. Each hook includes a web bordered by a vertical heel disposed in a slideway formed by grooves made in two opposing separating partitions with the web including a toe adapted to be hooked by the curved ends of a conventional blade element which is utilized to maintain the hooks in their uppermost elevated position. The hooks further include portions which are adapted to be gripped by conventional knives as the knives are moved vertically in reciprocating motion and also a push element adapted to displace the hook retaining blade against the core of an electromagnet which is used to selectively urge the retaining hook into engagement with the mobile hook when the electromagnet is activated.

4 Claims, 7 Drawing Figures

MOBILE HOOK FOR THE SHED FORMING DEVICE OF A WEAVING LOOM

BACKGROUND OF THE INVENTION

1. Field of the Invention

The present invention relates to an improved mobile hook for the shed forming device in a weaving loom.

2. History of the Related Art

Mobile hooks for the shed forming devices in weaving looms are known to include two hooks associated with each of the ends of a funicular element which is associated with one of the pulleys of a lifting beam. The lifting beam includes a second pulley around which passes the harness cord of the warp yarn which it is lifted or lowered. Each hook is provided with a lateral nose element cooperating with a knife which oscillates with a vertical reciprocating movement. In the prior art, the different elements of the shed forming devices are free in space, which leads to drawbacks. Firstly, the mobile hook associated with the ends of the funicular element are not guided, with the result that, if a harness cord breaks, it is very difficult to replace, especially if it is remote from the edge of the device in question. In addition, the fact that the hooks are not guided may causes them to drop to the centre of the device, which may cause an entanglement of the different funicular elements with one another or with the non-broken harness cords.

In addition, in the absence of guides for the mobile hooks, difficulties may be encountered in gripping the corresponding retaining hook since the path of the mobile hooks is not exactly determined.

These drawbacks have been partially overcome by grouping each system, composed of the mobile hooks, the lifting beam and the retaining hooks, between two separating partitions, thus enabling compact, independent assemblies to be made, and possibly grouped, in easily dismountable modules as disclosed in applicants' copending U.S. application Ser. No. 896,212 filed Aug. 14, 1986. However, these partitions do not prevent the drop of the hooks to the outside in the event of certain mishaps such as the break of a retaining hook. Moreover, the modules thus produced cannot easily be oriented other than vertically.

SUMMARY OF THE INVENTION

It is an object of the improvements forming the subject matter of the present invention to overcome these drawbacks and to produce a shed opening device of the type in question but wherein the mobile hooks are retained by slideways.

To this end, the shed forming device according to the invention is provided with mobile hooks each comprising, firstly, a heel which engages with clearance in a longitudinal slideway constituted by a groove made in each face of the separating partitions; secondly, a web which projects outwardly of each slideway to bear a toe and extends outwardly thereof to constitute a nose element which is driven by a knife; and thirdly, a push element adapted to approach the retaining blade which acts as the hook retaining mechanism when actuated by an electro-magnet at the end of stroke thereof and before the corresponding dead centre position of the hook.

According to a preferred embodiment of the invention, the grooves made in each face of the separating partitions comprise an outwardly oblique ramp adapted to place each mobile hook corresponding to a determined position on the one hand with respect to the end of the elastic blade provided to retain this hook, and, on the other hand, to the path of a knife.

Each ramp advantageously extends by a slope in opposite direction so as to define an edge against which each mobile hook rests at its upper dead centre position.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
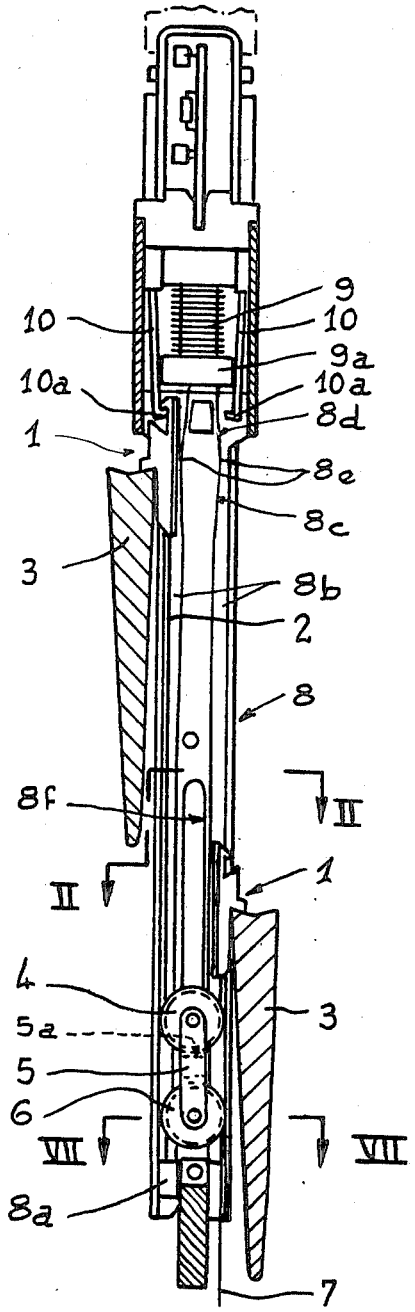
FIG. 1 is a transverse section of a shed forming device to which the improvements according to the invention are applied.

Referring now to the drawings, FIG. 1 illustrates one of the systems for lifting a warp yarn of a shed forming device of a weaving loom. This system comprises two identical hooks 1 associated with each of the ends of a funicular element such as a cord 2, each hook being lifted and lowered alternately by means of two knives 3. The cord 2 passes around a first pulley 4 of a lifting beam 5 which includes a second pulley 6 rotating in the same fork joint 5*a* as pulley 4. Around pulley 6 there passes a harness cord 7 of which the end opposite the one which is connected to the corresponding heddle is anchored at a fixed point 8*a* of one of the two vertical separating partitions 8 placed on either side of hooks 1.

The upper part of the separating partitions supports an electro-magnet 9 on either side of which are disposed two vertical elastic blades 10 of which the lower end 10*a* is curved with a view to retaining the corresponding hook 1.

Figure 2:
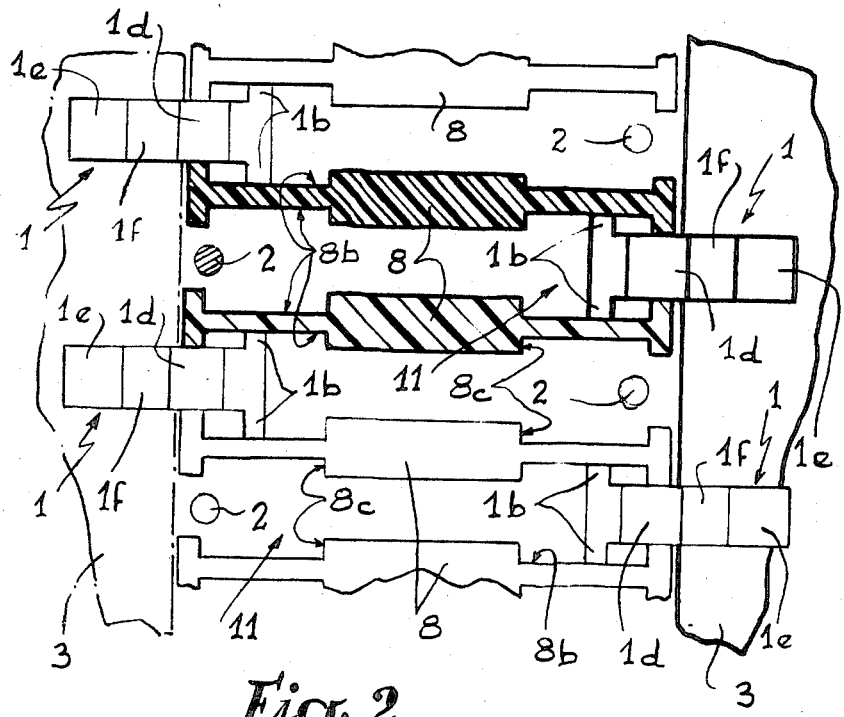
FIG. 2 is a section taken along line II—II of FIG. 1.

In accordande with the invention, the faces of each separating partition 8 are provided with two grooves 8*b*, so that, after assembly of two separating partitions these grooves define two adjacent slideways 11 (FIG. 2).

According to the invention, the cross section of each hook 1 is in the form of a T, i.e. it comprises a web 1*a* and a heel 1*b* of which the dimensions are such that web 1*a* passes between two separating partitions 8 without substantial clearance, while heel 1*b* is engaged in each of the slideways 11 of the separating partitions, as is illustrated more particularly in FIG. 2. In this way, each hook 1 is guided vertically, such guiding being accomplished while retaining the hook with clearance inside the slideways.

Web 1*a* of each hook 1 extends upwardly by a bar 1*c* which terminates in a toe 1*d*. Web 1*a* also includes a lateral nose element 1*e* by way of which it is lifted and lowered by the corresponding knife 3. Finally, parallel to bar 1*c*, hook 1 comprises a rigid push element 1*f*.

It will be observed that the upper part of each groove 8*b* is provided with a ramp 8*c*, inclined obliquely outwardly, i.e. towards the knife 3. This ramp extends upwardly by a slope 8*d* oriented in an opposite direction so that the slope and the ramp forms an edge 8*e* against which hook 1 rests in its upper dead centre, and which determines its transverse position with respect to the curved end of the blade 10 and to the path of its knife 3.

Figure 3:
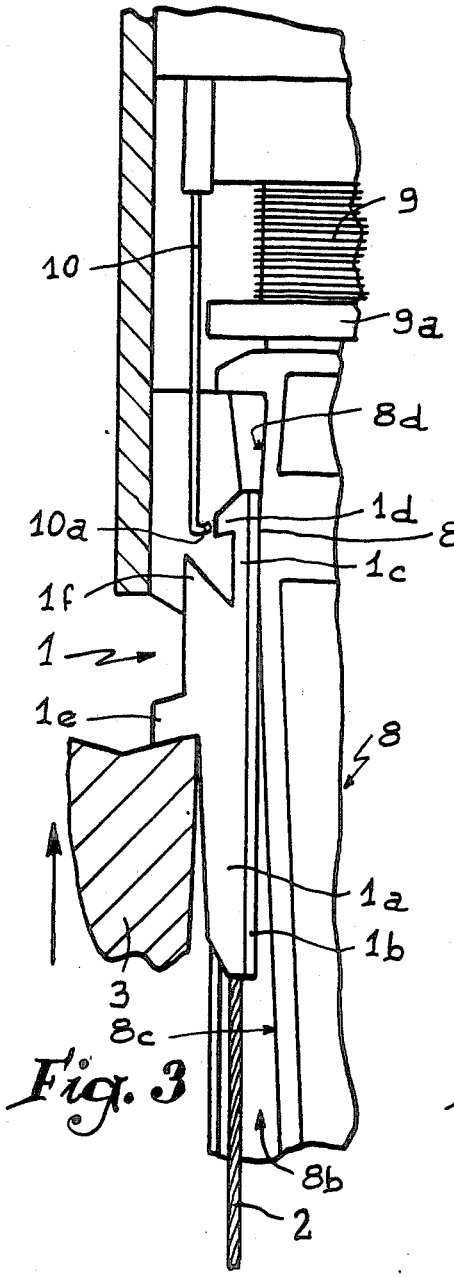
FIGS. 3 to 6 illustrate the operation of the device according to the invention and more particularly the manner in which its the mobile hooks are gripped by an upper elastic blade associated with an electro-magnet.
Figure 4:
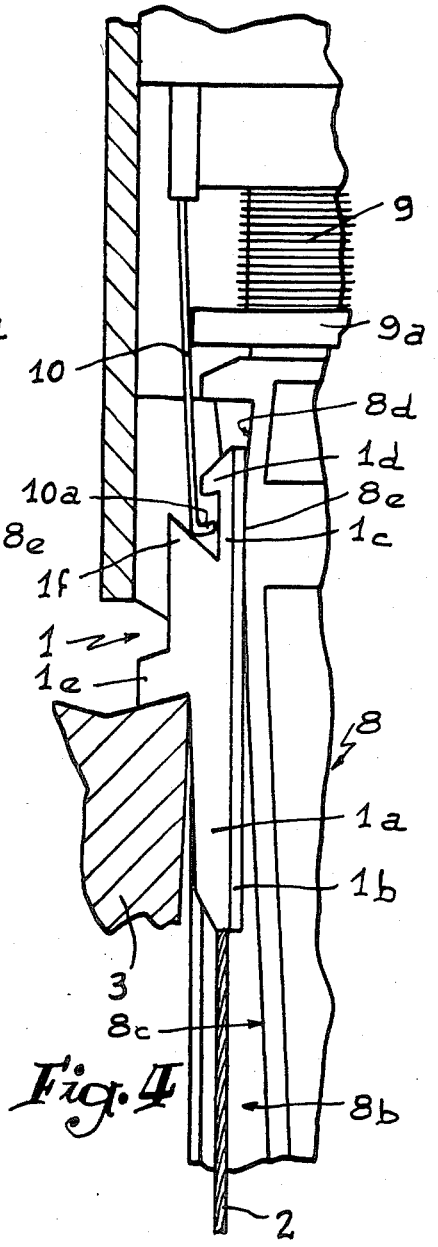

As illustrated in FIG. 3, when knife 3 rises and blade 10 is not attracted by the electro-magnet, the toe 1*d* of the hook escapes from the curved part 10*a* of the blade, while, at the end of stroke, a little before the top dead centre, the end of push element 1*f* which engages the curved end 10*a* of the blade in order to deform the blade towards the centre. At this moment, the blade is almost in abutment against the core 9*a* of the electro-magnet 9. A slight additional lift of hook 1 to reach its top dead centre (the position shown in FIG. 4) brings about a complementary pivoting of the blade which then comes into abutment against core 9*a* (FIG. 4).

Figure 5:
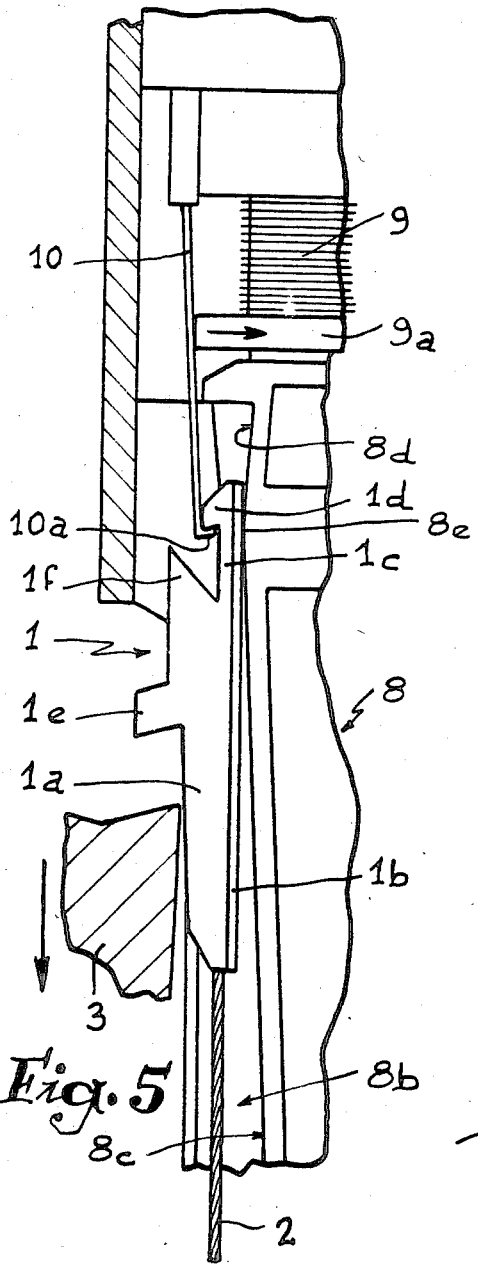
Figure 6:
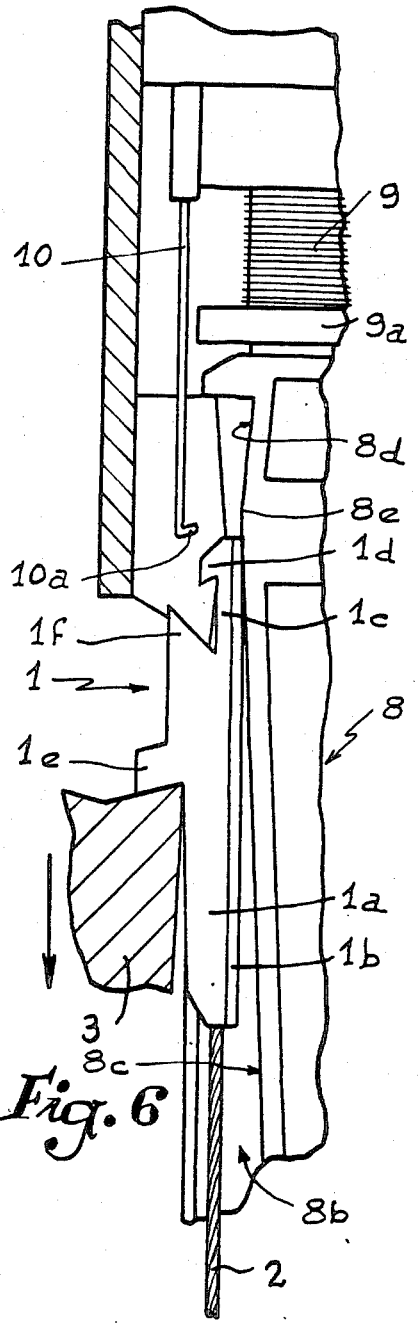

If, in this position, the electro-magnet 9 is energized, the blade remains applied against this core 9*a*, with the result that, during descent of knife 3, the toe of hook 1 remains hooked on the curved end 10*a* of blade 10, as illustrated in FIG. 5. On the contrary, if the electro-magnet is not energized, the blade returns by its own elasticity to the position of FIG. 3, so that the hook 1 redescends with knife 3 (FIG. 6).

Figure 7:
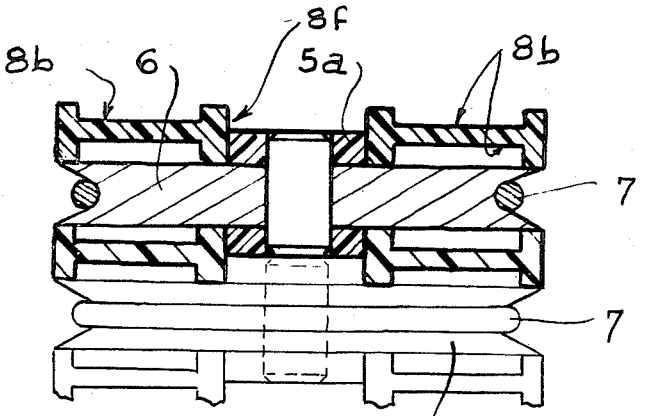
FIG. 7 is a section along VII—VII (FIG. 1).

As illustrated in FIG. 1, each separating partition 8 is provided with an oblong opening 8*f* adapted to guide the lifting beam 5. Such guiding is shown more particularly in FIG. 7 where it is observed that fork joint 5*a* is disposed in the opening 8*f* which constitutes a vertical guide for the lifting beam and enables its retention between two separating partitions 8. In this way, all the movable elements of a system for lifting a harness cord are retained between two separating partitions, so that a completely independent module may be made by assembling a certain number of separating partitions.

According to a preferred embodiment, the hooks 1 are made of an appropriate plastic material and overmoulded at each end of the cord 2.

It must, moreover, be understood that the foregoing description has been given only by way of example and that it in no way limits the domain of the invention which would not be exceeded by replacing the details of execution described by any other equivalents.

It will be readily understood that an assembly thus produced, or a group of assemblies of module, may be oriented in any manner, for example horizontally, as all the mobile elements are guided longitudinally with respect to the separating partitions.

What is claimed is:

1. In a weaving loom a shed forming device comprising a plurality of systems each having two mobile hooks movable between lower and upper positions by a movable knife means and connected by a funicular element, each of said mobile hooks having a toe portion which is selectively retained in said upper position by an elastic retaining blade which is movable in response to an electro-magnet, each of said systems being disposed between two vertically separating partitions assembled together to form an assembly, each of said partitions having opposing face portions including longitudinal grooves formed therein, each of said mobile hooks having a heel which is slideably and guidingly received within said grooves and between said separating portions, said mobile hooks also having a web which extends vertically between said partitions and which includes said toe portion and which also includes an outwardly extending nose element by which said hooks are driven by said knife means, and said hooks including a push element adjacent said toe portion which is engagable with said elastic retaining blade to urge said elastic retaining blade against said electromagnet jst prior to said hooks being at said upper positions whereby if said electromagnet is activated, said elastic retaining blades will retain said hooks in said upper position.

2. The shed forming device of claim 1 wherein said grooves made in each of said face portions of said separating partitions comprise an obliquely sloped ramp portion which guides said hooks to a first determined position with respect to said retaining blade.

3. The shed forming device of claim 2 wherein each of said obliquely sloped ramp portions extends to an oppositely oriented slope portion, an edge defined between said obliquely sloped ramp portion and said oppositely oriented slope portion, each of said mobile hooks resting against said edge when in said upper position.

4. The shed forming device of claim 1 wherein said mobile hooks are made of plastic material and are overmolded on the ends of said funicular element.

* * * * *